US005775071A

United States Patent [19]

Terwilliger

[11] Patent Number: 5,775,071

[45] Date of Patent: Jul. 7, 1998

[54] DEVICE AND METHOD FOR CORRECTING THE GAIT OF A BAD GAITED HORSE

[75] Inventor: Al G. Terwilliger, Clawson, Mich.

[73] Assignee: Protecto Horse Equipment Co., Clawson, Mich.

[21] Appl. No.: 728,741

[22] Filed: Oct. 11, 1996

[51] Int. Cl.[6] ..... B68B 1/00

[52] U.S. Cl. ..... 54/71

[58] Field of Search ..... 54/58, 71; 119/814

[56] References Cited

U.S. PATENT DOCUMENTS

| | | | |
|---|---|---|---|
| 895,471 | 8/1908 | Kelly | 54/71 |
| 4,027,462 | 6/1977 | Shand | 54/71 |
| 5,566,533 | 10/1996 | Larisch | 54/23 |

*Primary Examiner*—Robert P. Swiatek

*Attorney, Agent, or Firm*—James M. Diemen

[57] ABSTRACT

A device for correcting the gait of a bad gaited horse comprises soft flexible tubing with a strap routed therethrough. The tubing is placed in the armpits between the horse's body and the tops of the forelegs causing the horse to turn the knees of its forelegs slightly outwardly and thereby reduce a knock kneed or toes out condition. The strap has loops with buckles at the ends to adjustably connect with the shafts of a sulky. Shock cords provide tension between the loops and strap at the ends. Safety straps also connect the strap in the tubing with the loops and buckles at the ends. A chest strap with a buckle connects the strap and tubing across the chest of the horse. The device is placed around the neck of the horse and is buckled across the chest. The ends of the device are brought under the body between the front legs and snugged up by fastening the ends to the sulky shafts. With proper adjustment the tubing is positioned in the horse's armpits. The method of installing the device is also disclosed.

15 Claims, 3 Drawing Sheets

DEVICE AND METHOD FOR CORRECTING THE GAIT OF A BAD GAITED HORSE

BACKGROUND OF THE INVENTION

The field of the invention pertains to devices and methods for correcting the gait of horses, in particular, race horses attached to sulkies.

Horses with injured or deformed forelegs, knock knees, toe in or toe out stance, or having a bad gait have difficulty trotting or pacing straight. This can be particularly noticeable when the horse is in a race and pulling a race bike or sulky. The lack of straight tracking by the horse negatively impacts pleasure riding also.

A horse with a straight tracking problem such as toe in or toe out has a strong chance of hitting its knees, shins and legs together repeatedly thereby causing discomfort and perhaps injury to the horse. This problem is particularly important for trotters and pacers which will repeatedly forcefully strike their forelegs together when racing.

Traditionally, if a horse exhibited such a condition, the condition was limited by placing a device to connect and space the legs apart themselves. Spreaders and gliders pull the horse's front legs apart to force a straight gait. However, these devices only work with some race bikes or sulkies. Moreover, the spreaders and gliders can burn and chafe the horse and can cause the horse to tire easily as the horse's natural although bad gait is restricted.

Thus, the need exists for a device and a method to guide the gait of a horse which most of all reduces injury, allows free movement and does not tire the horse. The gait guide ideally should not interfere with other equipment the horse may be wearing (hobbles, hobble hangers, harnesses, etc.). The gait correcting device should be usable with pacers or trotters, for harness racing and pleasure riding.

SUMMARY OF THE INVENTION

The improved device for correcting the gait of a horse is fitted to the forebody of a horse in a unique manner that gently guides the position of the horse's forelegs. As the device is body mounted it causes no negative interference with the forelegs of the horse. The device is particularly effective in correcting toe out and thereby reducing or preventing knee knocking (striking the knee, ankle, shin or forearm).

Essentially, the invention comprises soft flexible tubing with a sturdy strap routed through the tubing. At each end of the strap there is a shock cord affixed to a loop and a buckle to attach the device to a sulky shaft. Another strap connects between the strap in the tubing and the loop and buckle. This additional strap provides a measure of safety should the shock cord break.

The device is used by placing it around the neck and shoulders of the horse and buckling an additional short strap across the chest. The tubing is placed in the armpit adjacent the brisket, thus between the horse's body and the top of each foreleg causing the horse to turn its knees out and its forelegs otherwise slightly and gently inwardly. This gently inward twist results in correction of the toed out condition and correction of the gait.

The ends of the device are brought under the body between the front legs and brought into an upwardly direction. The ends are snugged up by fastening the ends to the sulky shafts or to hitches on the sulky shafts. The more vertical the line of the device from the armpit toward the shaft the better the device operates. Thus, the more the device turns the knee out and reduces the toe out, the better the corrected gait with the object being a straight gait.

Each end has a loop with a buckle to allow for adjustable positioning either to the shaft or to the other end of the device if no sulky is used. If the device is connected to a sulky shaft, the loop is wrapped around the shaft overlapping itself for binding attachment and then is buckled in position. If a hitch having openings is mounted on the sulky shaft, then the loop is routed through the openings with the shock cord in front of and below the hitch.

The shock cord provides a tension device connecting between the end of the strap and the loop with the buckle. The shock cord helps maintain the device attached to the sulky shaft with a pretension that is adjusted when the device is placed on the horse and attached to the shafts. The buckled chest strap that connects across the chest of the horse retains the device in proper position by adjusting the distance between the descending portions of the device below the neck and above the armpits.

The careful positioning of the gait guide according to the invention gently turns the horse's knees out consequently straightening the horse's foreleg stride. The tipping of the knees outwardly correspondingly forces the leg movements outwardly and toes inwardly thus straightening the gait. A very natural motion is created with the gait correcting device. Interfering contact of the forelegs is reduced or eliminated. The device is easily adaptable to all types of race bikes or sulkies. A distinct advantage is the reduction or elimination of chafing and allowance of the horse's natural motion because the soft tubing only contacts the forelegs under the armpits where leg motion is least. Additionally, the device may be used without a race bike or sulky to help riding horses with gait problems.

For a more complete understanding of the present invention, reference is made to the following detailed description when read in conjunction with the accompanying drawings wherein like reference characters refer to like elements throughout the several views.

DESCRIPTION OF THE PREFERRED EMBODIMENTS

Figure 1:
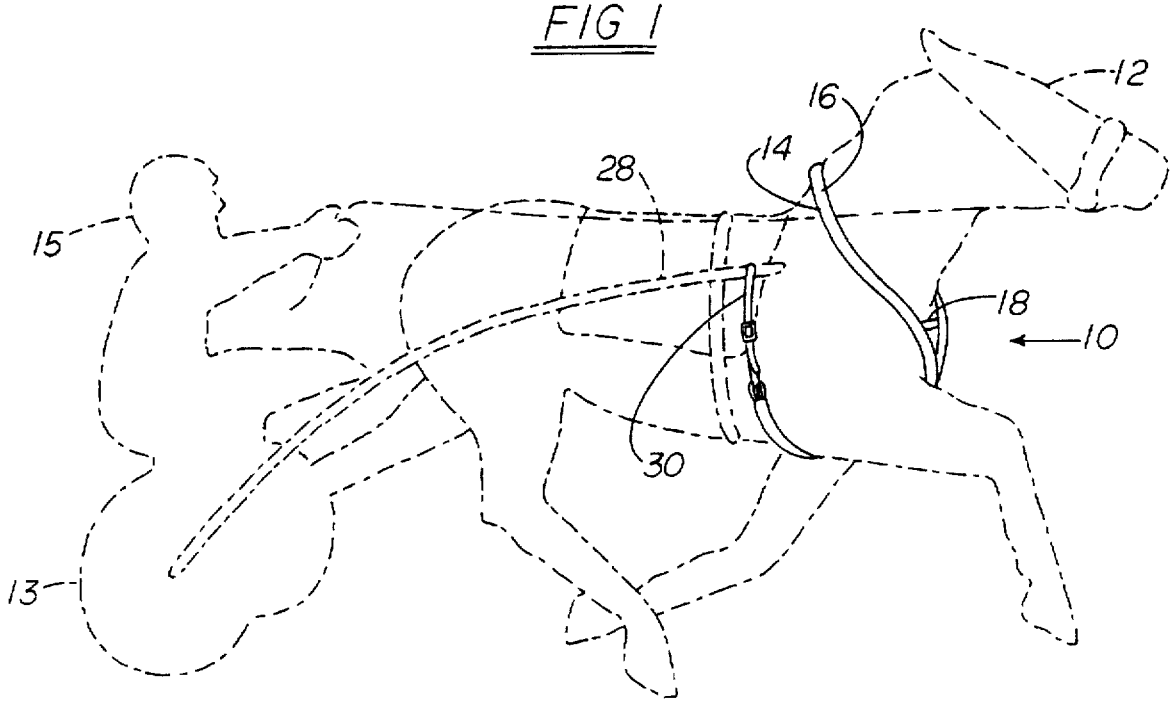
FIG. 1 illustrates a side view of the gait correcting device according to the invention with the horse, sulky and rider being shown with phantom lines.
Figure 2A:
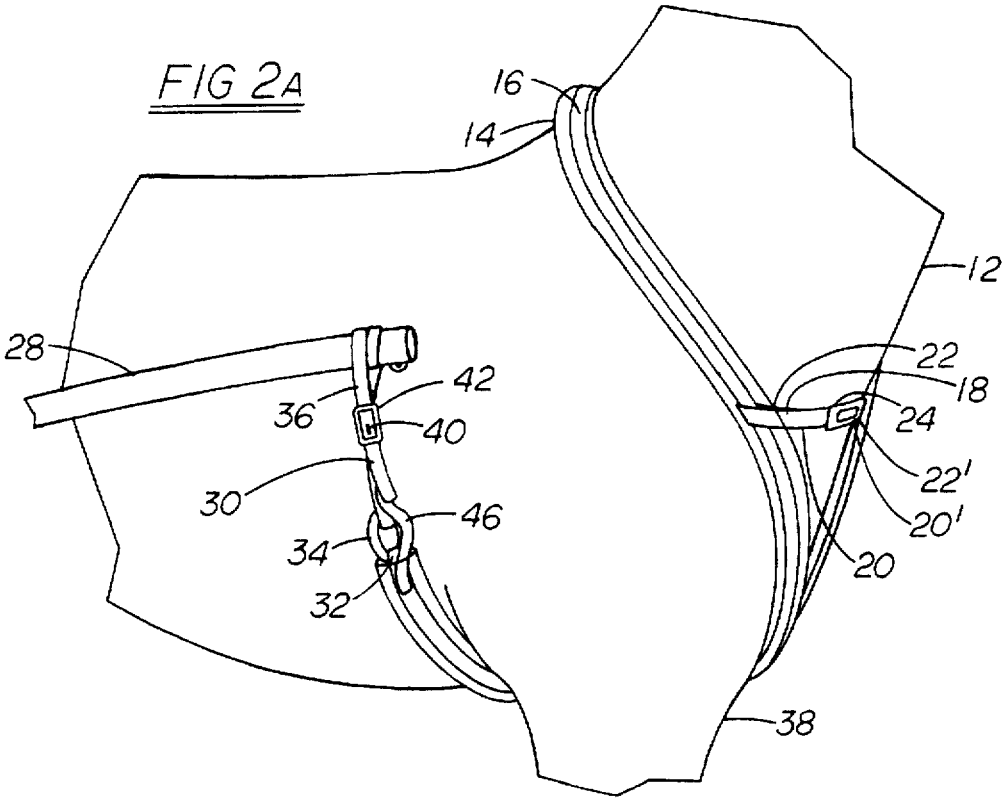
FIG. 2A illustrates an enlarged view of the device showing the shock cord between the strap and the loop with the buckle and the parallel safety strap.

In FIGS. 1 and 2, a gait correcting device generally denoted as 10 is shown. The gait correcting device 10 is positioned on a horse 12 (horse 12, sulky 13 and rider 15 shown in phantom). The gait correcting device 10 comprises flexible tubing 14 with a strap 16 routed therethrough. The flexible tubing 14 may be made of soft plastic material, rubber, leather or synthetic material. The flexible tubing 14 may be transparent and the element of transparency is beneficial to assessing the condition of the strap 16. The surface of the tubing 14 is selected for minimizing chafing or other irritation of the horse's hide. A soft transparent plastic tubing is preferred.

Figure 2B:
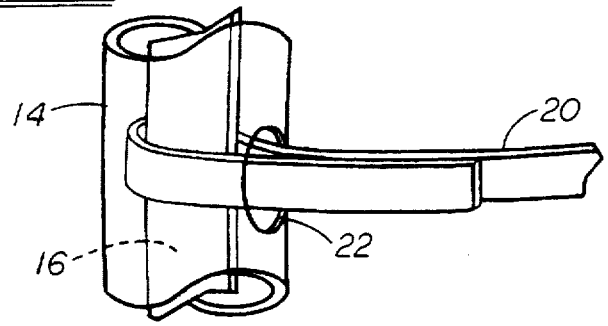
FIG. 2B is a detail of the connection between the chest strap and the tubing strap.

Connecting means 18 are provided to join the strap 16 across the chest of the horse 12. The connecting means 18 comprise chest straps 20, 20' inserted through elongated slots or apertures 22, 22' in the transparent tubing 14. The chest straps 20, 20' directly attach or encircle the strap 16 as best shown in FIG. 2B to also limit twisting of the strap 16 within the tubing 14. The strap 16 and the chest straps 20, 20' may be formed from biothane webbing, or other materials such as nylon, leather, rope cord, wire or nylon webbing. The chest straps 20 and 20' are provided with a buckle 24 for selectively adjusting the position of the device at chest level.

Figure 3:
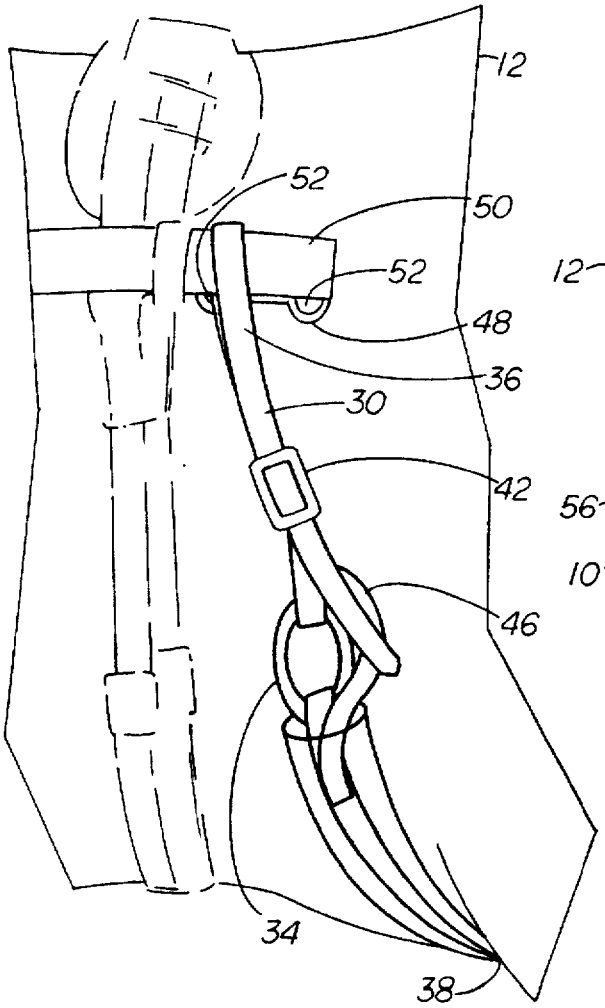
FIG. 3 illustrates an enlarged partial view of the device connected adjacent a sulky shaft hitch.

In FIGS. 2 and 3 retaining means 30 for the ends 32 of the strap 16 are shown. The retaining means 30 are described as to the end 32 shown. However, the retaining means 30 are provided at the other end of the device 10 on the other side of the horse 12. The retaining means 30 extend from tensioning means 34 which in turn are connected to the end 32 of the strap 16.

The retaining means 30 comprises a loop portion 36 double wrapped about a sulky shaft 28 and having adjustment means comprising a tongue 40 and buckle 42 mounted on the loop portion 36. Thus, the tension on the strap 16 can be adjusted with the retaining means 30 and maintained by the tensioning means 34.

The tensioning means 34 is shown as a shock cord but other known tensioning devices such as rubber straps or elastic straps could be advantageously employed. The tensioning means 34 allow the horse to move with its natural gait yet retains the gait correcting device in the horse's armpit 38. The shock cord 34 can be easily replaced at minimal cost when required.

The retaining means 30 is also connected to the end 32 of strap 16 by a safety strap 46. The safety strap 46 is essentially a safety device disposed between the end 32 and the retaining means 30. Strap 46 protects both the horse and the rider should the tensioning means 34 break.

FIG. 3 shows the retaining means 30 attached to a hitch 48 on a sulky shaft 50. The hitch 48 forms a plurality of openings 52 with the sulky shaft 50. The loop portion 36 of the retaining means 30 is routed through one opening 52 of the hitch 48 and is retained by the buckle 42. The loop portion 36 encircles the sulky shaft 50 and extends through the opening 52 to provide a more positive attachment to the shaft 50 and eliminate the need to double wrap as in FIG. 2.

Figure 4:
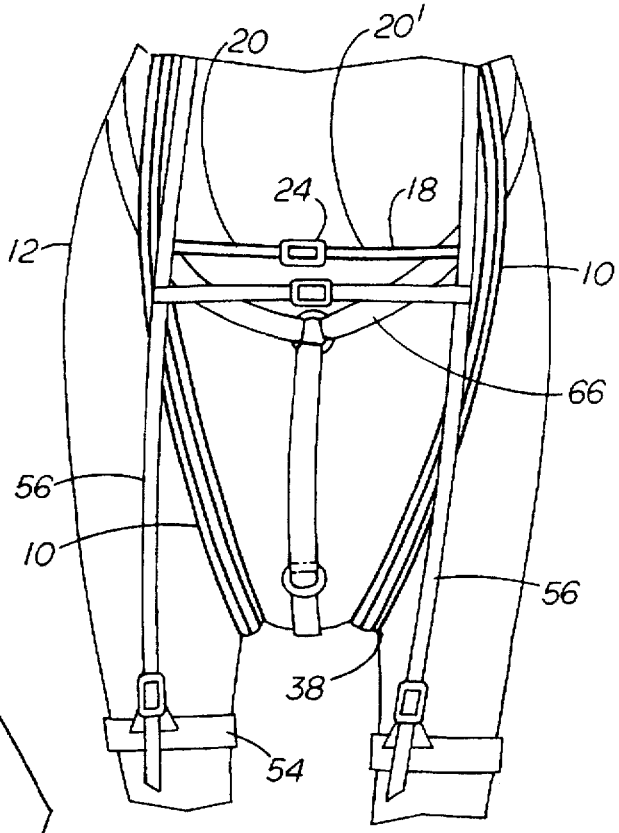
FIG. 4 illustrates a front view of the device on a horse with other equipment thereover.

In FIG. 4, the device 10 is worn by a horse with the horse also wearing other equipment, such as hobbles 54 with a hobble hanger 56. The hobble hanger 56 is fitted over the gait correcting device 10. A breast collar 66 is previously fitted on the horse before the gait correcting device and the hobbles 54.

Figure 5:
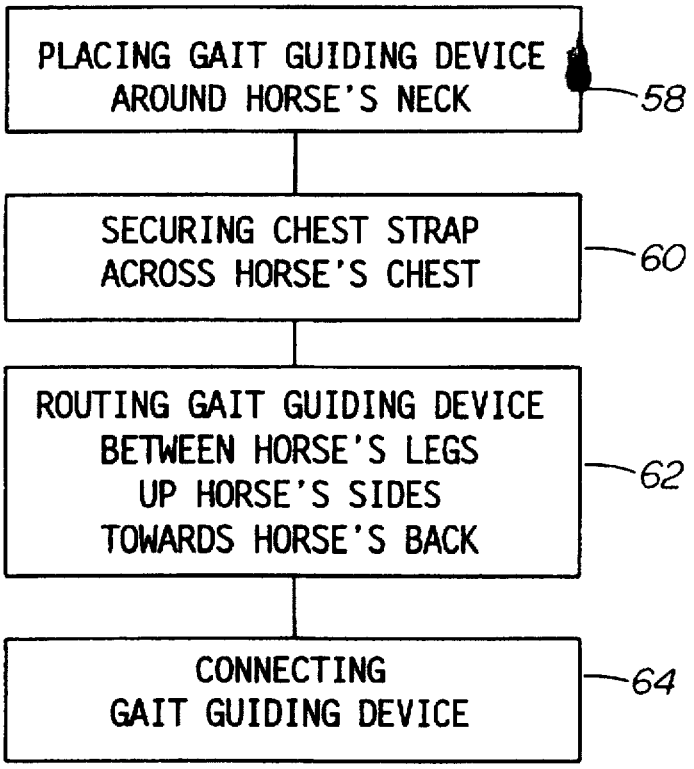
FIG. 5 is a flow diagram illustrating the steps of the method for installing the gait correcting device on a horse.

In FIG. 5, the steps to install the invention are shown.

The first step 58 is placing the gait correcting device 10 around a horse's neck.

The second step 60 is securing the chest strap 18 across the horse's chest.

The third step 62 is routing the gait correcting device between the horse's legs and up the horse's sides towards the horse's back.

The final step 64 is connecting the gait correcting device with the retaining means 30 on each side of the horse to the shafts 28 or 50, or in the alternative over the horse's back and adjusting the buckles 24 and 42 for suitable placement and tension to properly position the device in the horse's armpits 38.

Having described my invention, many modifications thereto will become apparent to those skilled in the art to which it pertains without deviation from the spirit of the invention as defined in the appended claims.

We claim:

1. A gait correcting device adapted to fit over the neck and under the armpits of a horse, the device comprising flexible tubing having an aperture through the tubing, a strap through the aperture of the tubing, the strap having a first end and a second end, means for connecting a section of the strap inside the tubing to another section of the strap inside the tubing, a first retaining means affixed to the first end of the strap, a second retaining means affixed to the second end of the strap, a first tensioning means between the first retaining means and the first end of the strap, a second tensioning means between the second retaining means and the second end of the strap, and the first and second retaining means being attachable to another device for retaining the gait correcting device on a horse.

2. The gait correcting device for a horse according to claim 1 wherein the means for connecting comprises a pair of chest straps having a buckle to adjustably join the chest straps.

3. The gait correcting device for a horse according to claim 2 wherein the tubing has elongated slots and the chest straps are attached to the straps through the elongated slots.

4. The gait correcting device for a horse according to claim 1 wherein the tubing is sufficiently soft whereby chafing is reduced.

5. The gait correcting device for a horse according to claim 1 wherein the first and second retaining means each comprise a loop portion and an adjustable buckle engaged with the loop portion.

6. The gait correcting device for a horse according to claim 5 wherein the first and second retaining means are engageable with a sulky shaft.

7. The gait correcting device for a horse according to claim 6 wherein the first and second retaining means are each engageable with a hitch on a sulky shaft.

8. The gait correcting device for a horse according to claim 1 wherein the tensioning means comprise shock cords.

9. A method for correcting the gait of a horse, the method using the device according to claim 1 and the method comprising the following steps:

positioning the gait correcting device over the neck and under the armpits on the horse, connecting the gait correcting device by the means for connecting, and attaching the first and second retaining means to properly position and retain the device on the horse.

10. The method for correcting the gait of a horse according to claim 9 wherein attaching the retaining means comprises double wrapping the retaining means about a pair of sulky shafts.

11. The method for correcting the gait of a horse according to claim 9 wherein the retaining means are attached to hitch openings on a pair of sulky shafts.

12. A gait correcting device for a horse comprising a soft flexible tube of sufficient length to fit over the neck and under the armpits of a horse, a strap through the tube, the strap having a first end and a second end, retaining means on the first and second ends of the strap, first tensioning means between the first end and first retaining means and second tensioning means between the second end and the second retaining means, and means for positioning and retaining the device on a horse.

13. A gait correcting device for a horse according to claim 12 wherein the tube is transparent.

14. A gait correcting device for a horse according to claim 12 wherein the retaining means on the first and second ends of the strap are attachable to a vehicle.

15. A method for correcting the gait of a horse by urging the foreknees outwardly, the method comprising the following steps:

placing a gait correcting device over a horses neck and down over the horses chest, securing a chest strap across the horses chest, routing the gait correcting device between the horse's legs and closely under the horse's armpits to gently urge the horse's foreknees outwardly, further routing the gait correcting device up the horse's sides towards the horse's back, and adjustably connecting the gait correcting device to properly position and retain the device on a horse.

* * * * *